United States Patent [19]

Kamille

[11] Patent Number: 4,964,642

[45] Date of Patent: Oct. 23, 1990

[54] VARIABLY SCORED SKILL GAME

[75] Inventor: Stuart J. Kamille, Glenbrook, Nev.

[73] Assignee: Longview Corporation, Reno, Nev.

[21] Appl. No.: 352,146

[22] Filed: May 15, 1989

[51] Int. Cl.[5] ..... A63F 3/00

[52] U.S. Cl. ..... 273/240; 434/346; 434/348; 283/100; 273/153 R

[58] Field of Search ..... 273/240, 272, 139, 153 R; 283/100–104; 434/346, 348

[56] References Cited

U.S. PATENT DOCUMENTS

| | | | |
|---|---|---|---|
| 3,826,499 | 7/1974 | Lenkoff | 273/240 |
| 3,918,174 | 11/1975 | Miller et al. | 434/346 |
| 4,179,126 | 12/1979 | Coefield | 273/240 |
| 4,714,254 | 12/1987 | Calloway | 273/249 |

OTHER PUBLICATIONS

Washington Daily News, "Pruzzle", Mar. 20, 1967, p. 52.

*Primary Examiner*—Benjamin H. Layno
*Attorney, Agent, or Firm*—Brian C. Kelly

[57] ABSTRACT

A skill game for home or promotional use in stores or in fast food restaurants that provides a player with a degree of self-determination and provides an inducement to perspective customers. The score is dependent on the player's skill and his confidence in his answer. This game provides a variable scoring system where each additional clue which is revealed reduces the score of a correct answer.

25 Claims, 3 Drawing Sheets

VARIABLY SCORED SKILL GAME

FIELD OF THE INVENTION

The present invention is directed to a game, particularly a game of skill. While the game is applicable to use as a contest between two or more players, it is most advantageously employed as a promotional game in the field of consumer sales.

BACKGROUND OF THE INVENTION

Contest games have often been used in the retail sales area, and in a variety of ways. Games are used, for example, in the fast food industry as an inducement to perspective customers to patronize a particular establishment or chain of establishments. In such a use, the prizes awarded are generally the products purveyed by the particular establishment, as well as, or in addition to, cash, trips, or other merchandise.

One application of the invention is for promotional purposes. The most important aspect of a promotional game is control of the prize winner. The promoter must be guaranteed that there will be only one ultimate winner. In the prior art, the primary method of assuring that there would be a single ultimate winner was to incorporate chance. Thus, in the prior art, a manufacturer would produce a limited number of winning pieces and a much larger number of losing pieces.

Games have frequently been used in the promotion of consumer products, either to increase the sales of a particular brand because of the inducement provided by the prizes available through successful completion of the game, or as a means to introduce a new product. For example, U.S. Pat. No. 4,756,532 to Kamille describes a game with a playing surface having two fields of play. The first field of play provides a plurality of multiple choice questions, each of the choices being identified by a symbol. The second field of play combines the symbols identified in the first field of play to provide an answer to a question or inquiry there.

SUMMARY OF THE INVENTION

An object of the invention is to provide a multiplayer skill game in which the player is faced with a choice as to where the game ends, wherein winning is dependent on a player's skill, and the score is dependent on the player's confidence level.

Another object is incorporating a scoring system by which the prize winners of a promotional game can be limited.

The invention includes:

A game with a playing surface having one or more playing fields. One of the playing fields has a player response area. For each playing surface, there exists a designated elicited response. One or more clues are printed on the playing surface, and the clues are each related to the elicited response in some way.

The inventive method includes:

A method of playing a game including reading a clue on a playing surface and marking a response that is analytically determined to parallel an elicited response.

An alternative embodiment includes:

A skill game with multiple playing surfaces, each having one or more fields of play, a player response area, one or more clues, an elicited response, and a scoring system.

DESCRIPTION OF THE PREFERRED EMBODIMENTS

Figure 1:
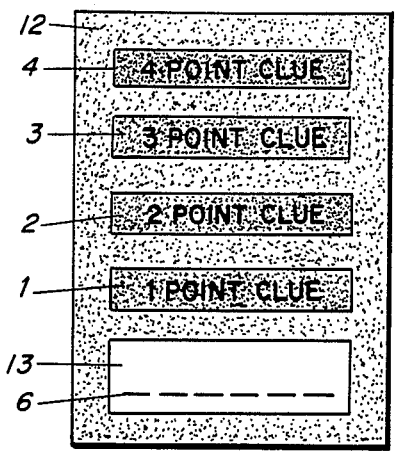
FIG. 1 is a representation of a playing surface or card at the beginning of play.

Referring to the accompanying drawings, wherein like reference numerals designate identical or corresponding parts throughout the several views and more particularly in FIG. 1, a playing surface or card 12 is provided with a single field of play including a player response area 13 with a number of letter spaces 6 which corresponds exactly to a the number of letters required to spell an elicited response. The card also has printed on its face four clues 1–4 to that elicited response; each clue is covered with a removable concealing material.

Figure 2:
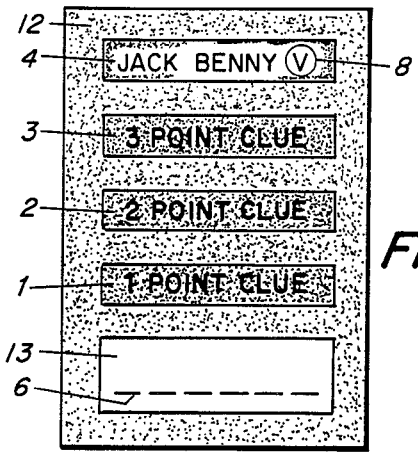
FIG. 2 is a representation of a playing surface or card of FIG. 1 wherein a clue is revealed.
Figure 3:
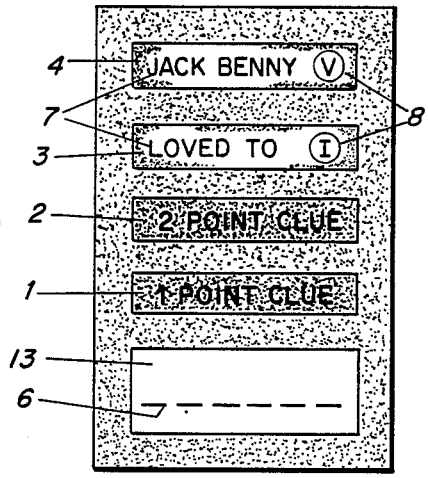
FIG. 3 is a representation of a playing surface or card of FIG. 1 wherein two clues have been revealed.
Figure 4:
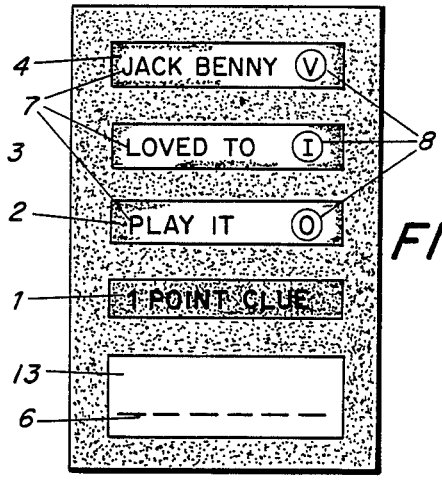
FIG. 4 is a representation of a playing surface or card of FIG. 1 wherein three clues have been revealed.
Figure 5:
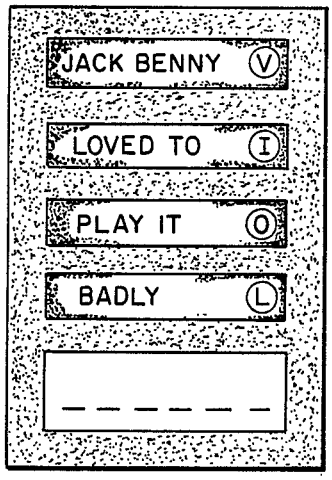
FIG. 5 is a representation of a playing surface or card of FIG. 1 wherein four clues have been revealed.
Figure 6:
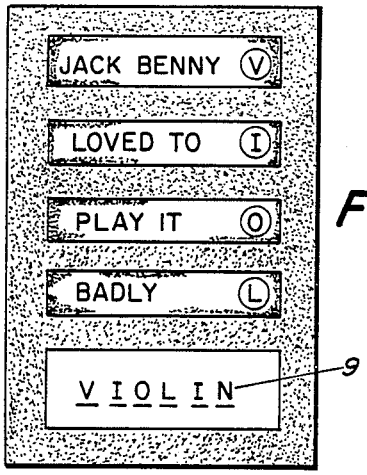
FIG. 6 is a representation of a playing surface or card of FIG. 1 wherein four clues have been revealed and an answer has been marked by a player in the response area.

The game as illustrated in FIGS. 1–6 is a game of skill with an element of discretionary risk, but without a factor of chance or predetermination. A player takes up a game piece as shown in FIG. 1 and immediately is given an indication of the elicited response. The correct response will contain the same number of letters as the number of spaces 6 provided in the player response area 13. In FIG. 2 a clue has been revealed by removing the concealing material to provide the player with both a word prompt 7 and a letter prompt 8. Therefore, the player might mark an answer into the player response area 13 knowing that; the elicited response has some relation to the word prompt 7 and contains the letter prompt 8 somewhere amongst its letters. Alternatively, the player may reveal another clue. The player is faced with a choice of entering a response based on the information already presented by the first clue 4 or, the player may reveal a second clue as shown in FIG. 3, however, each clue that is revealed reduces the point value of this card so it is to the player's advantage to make a determination as soon in the game process as possible. FIG. 3 shows a game card 12 wherein two clues have been revealed, again a player must make a decision whether to enter a response or reduce the point value of the card and reveal further clues as shown in FIGS. 4 and 5. Finally, in FIG. 6 the player enters a response 9 which the player hopes will parallel the elicited response based on the relation of the word prompts 7 and letter prompts 8 and the space prompt 6. In an alternate embodiment, the number of clues can be extended to match the number of letters in the response so that at some point the entire response is revealed with the game piece still maintaining some point value. Again, referring to FIG. 1 as a player collects more and more game pieces he may choose to guess at a response based on the number of spaces 6 provided, thus not requiring a first clue 4 to be revealed.

Figure 7:
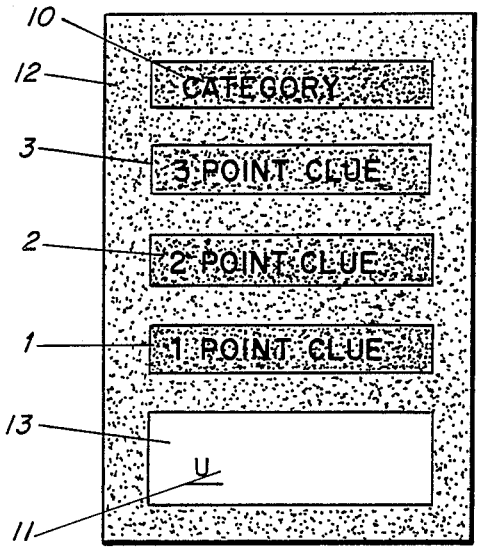
FIG. 7 is a representation of a second embodiment of a playing surface or a card wherein a category is denominated with three clues.
Figure 8:
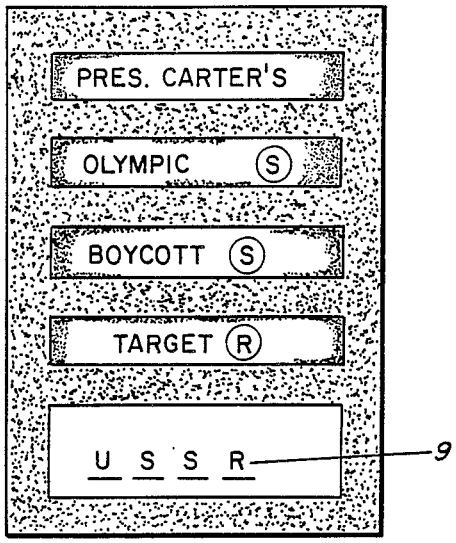
FIG. 8 shows a representation of a playing surface or card as in FIG. 7 where the category and all three clues are revealed and an answer is written in the response area by a player.
Figure 9:
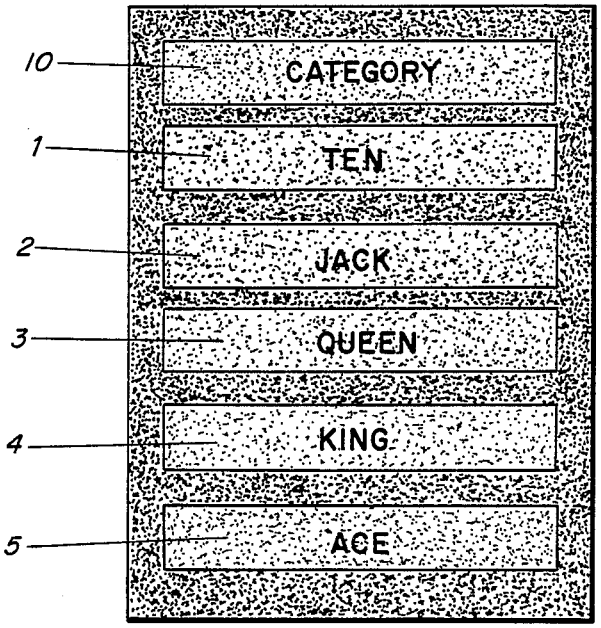
FIGS. 9–12 show an alternate embodiment of a playing surface disclosing five inquiries with individual player response areas with difference inquiries revealed.
Figure 10:
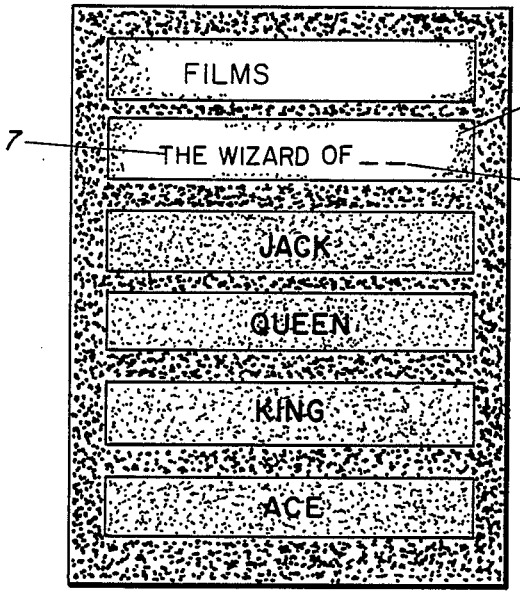
Figure 11:
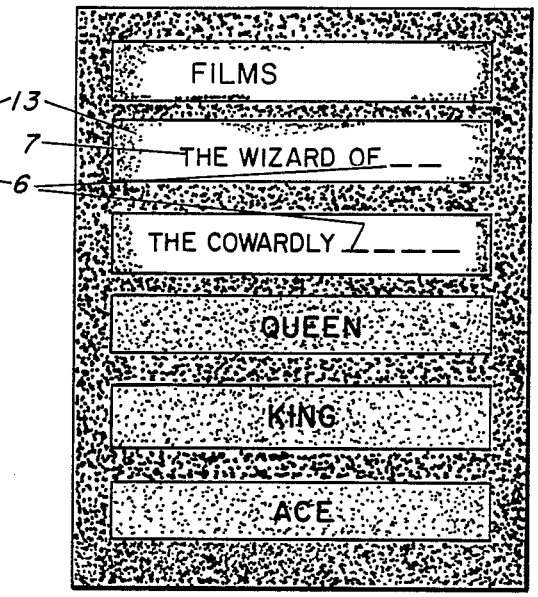
Figure 12:
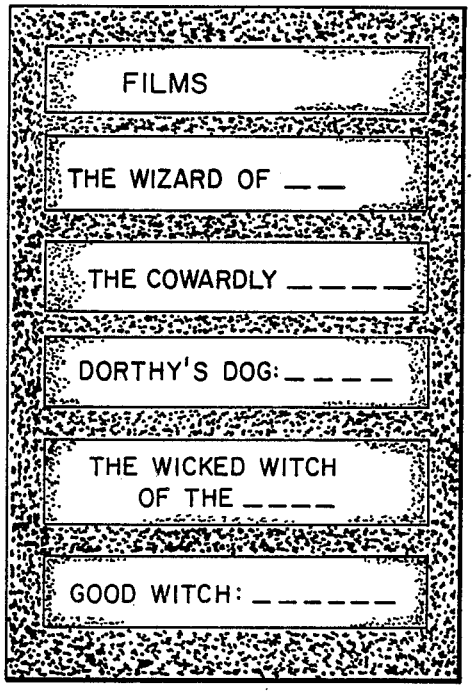

FIG. 7 shows an alternate embodiment, including a free letter 11 either instead of the space prompt 6. In another alternate embodiment, both a free letter and space prompt could be used. FIG. 7 also provides a printed category 10 to help the player to focus on a particular subject area. FIG. 8 shows clues 1–3 revealed and a response 9 written in by a player.

The word prompts 7 can be either descriptive words, synonyms, neumonics that trigger an association or counter-association to a player or predetermination of a winner by random selection or, as show in FIG. 8 above, the clues can make up a sentence to described an elicited response.

Another alternative embodiment is shown in FIGS. 9–12 wherein a category designation 10 is covered by a removable concealing material, and the clues 1–5 are individual inquiries each with a player response area 6. In this embodiment of the game, the player can reveal and answer the inquiries sequentially or randomly. This embodiment is scored based on the number of correct answers. As in the above embodiments, there is no score if any response is incorrect.

Another alternative embodiment includes a scoring system which incorporates the suits, face characters and numbers of an ordinary card deck.

Another alternative embodiment includes a scoring system which allows the player to collect a set such as the fifty states wherein each of the questions represents a state and up to five states are available on each card.

This invention has successfully eliminated chance, while maintaining a factor of self-determination that puts the fate of the player under his own control as opposed to being subject to a random event. This ability to effectively wager on one's skill without being subject to chance is a great advance over the prior art. The scoring system includes the provision that only correct responses receive any score and the score for each game piece is dependent on the number of clues that have been revealed in whole or in part. An ultimate winner is assured by providing that the largest point total wins. Ties can be broken or the prize divided. Alternate embodiments could include picture clues in addition to or in place of word prompts and letter prompts.

In game surfaces the present invention are to be employed in a promotional type of game, and obviously, they will be single use type of playing surfaces; i.e., the playing surfaces submitted to some agency who collects and tabulates the scores. On the other hand, if the playing surface or cards are to be used in a contestant-type of game, it may be desirable to form the cards of washable type surface, so that, once the answers and scores are tabulated, the answers can be wiped off of a card and the card reused. Obviously, whichever type of game the playing surfaces or cards are employed in, there will be a plurality of such cards, each containing different questions and clues and the degree of difficulty can be varied.

Obviously, many modifications and variations of the present invention are possible in light of the above teachings. It is therefore to be understood that within the scope of the intended claims the invention may be practiced other than as specifically described.

What is claimed as new and desired to be secured by Letters Patent is:

1. A game comprising in elicited response having a plurality of portions, a playing surface having at least one playing field comprising a player response area to be marked by a player with a response approximating said elicited response, and multiple clues to said elicited response printed thereon and concealed by removable concealing means: each of said concealed clues comprising at least one word and a portion of said elicited response to aid in determining said elicited response.

2. A game as described in claim 1, wherein at least one of said clues comprises a printed letter which is among the letters which spell an elicited response, to be marked in said player response area.

3. A game as described in claim 2, wherein at least one of said clues seated on said playing surface further comprises at least one word related to said elicited response.

4. A game as described in claim 3, wherein at least one of said clues comprises at least one word synonymous with said elicited response.

5. A game as described in claim 4, wherein said player response area further comprises a number of spaces designated for marking letters on said playing surface which corresponds to the number of letters in said elicited response.

6. A game as described in claim 5, wherein said playing surface further comprises a category designation printed thereon.

7. A game as described in claim 4, wherein said player response area further comprises at least one printed letter of said elicited response displayed thereon.

8. A game as described in claim 1, wherein said clues have point values such that a surface with fewer concealing means removed has a higher potential point value than another surface with more concealing means removed.

9. A game as described in claim 8, wherein clues are of varying assistance in choosing a response which approximates to said elicited response.

10. A method of playing a game comprising the steps of: providing an elicited response having a plurality of portions; providing a playing surface having at least one field of play thereon and multiple concealed clues displayed thereon, each of said concealed clues comprises a word, and a portion of said elicited response; revealing and reading a first clue, and choosing to mark a response in a player response are, located in said field of play, which player believes to approximate said elicited response in light of the information revealed by said first clue, versus revealing a second clue.

11. A method as described in claim 10, wherein said player response area comprises a number of spaces which correspond to the number of letters in an elicited response.

12. A method as described in claim 11, further comprising the step of marking letters which spell said response in said spaces.

13. A method as described in claim 12, wherein said playing surface comprises two or more clues concealed by removable concealing means.

14. A method as described in claim 13, wherein said clues have varying point values such that points are accumulated only if said response matches said elicited response, and available points are reduced for each clue that is revealed.

15. A method as described in claim 14, including the additional step of removing said concealing means from at least one clue with the effect of increasing the likelihood of matching said response with said elicited response, and simultaneously reducing the available points.

16. A method as described in claim 10, wherein said step of choosing to mark a response further comprises first revealing and reading a second clue.

17. A method as described in claim 16, wherein said step of choosing to mark a response further comprises the steps of first revealing and reading another clue.

18. A skill game comprising multiple playing surfaces, each having an elicited response, each having at least one playing field thereon; said field comprising a player response area for a player to mark a response which he calculates to correspond to said elicited response, each said surface having at least one clue displayed thereon which provides assistance to said player in choosing a response to mark in said player response area, and a scoring system having a unit value represented on each clue, a score is determined by the number of said clues having a removable concealing means removed.

19. A game as described in claim 18, wherein said scoring system comprises no score for a playing surface wherein said response marked in said player response area fails to correspond to said elicited response, and a score unit value for said response marked by said player which correctly corresponds to said elicited response.

20. A game as described in claim 19, wherein said scoring system further comprises a designation of winner which is assigned to a player who has accumulated the greatest number of score units.

21. A game as described in claim 20, wherein said scoring system further comprises a score unit value for each clue which remains concealed, only if said response corresponds to said elicited response.

22. A skill game comprising an elicited response, a playing surface having at least one playing field thereon comprising a player response area to be marked by a player with a response approximating said elicited response, and multiple clues to said elicited response printed thereon and concealed by a removable concealing means; at least one of said clues comprising at least one word to aid in determining said elicited response and a scoring system having a unit value represented on each concealed clue, a score is determined by the number of said clues having said removable concealing means removed.

23. A game as described in claim 22 further comprising at least one clue concealed by removable concealing means.

24. A game as described in claim 23 wherein said scoring system comprises a designation of no score for a playing surface where a response marked in a player response area does not correspond to corresponding elicited response, and a score unit value is assigned cumulatively for each marked response which corresponds to a corresponding elicited response.

25. A game as described in claim 24 wherein said scoring system further comprises a designation of winner which is assigned to a player who accumulates a collection of appropriate score unit values through any combination of playing surfaces to complete a predetermined set.

* * * * *